US010741134B2

(12) United States Patent
Chen

(10) Patent No.: US 10,741,134 B2
(45) **Date of Patent: *Aug. 11, 2020**

(54) DISPLAY APPARATUS AND METHOD FOR DRIVING DISPLAY PANEL THEREOF

(71) Applicants: HKC CORPORATION LIMITED, Shenzhen (CN); CHONGQING HKC OPTOELECTRONICS TECHNOLOGY CO., LTD., Chongqing (CN)

(72) Inventor: Yu-Jen Chen, Chongqing (CN)

(73) Assignees: HKC Corporation Limited, Chongqing (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/740,499

(22) PCT Filed: May 26, 2017

(86) PCT No.: PCT/CN2017/086131

§ 371 (c)(1),
(2) Date: Dec. 28, 2017

(87) PCT Pub. No.: WO2018/113190

PCT Pub. Date: Jun. 28, 2018

(65) Prior Publication Data

US 2020/0035172 A1 Jan. 30, 2020

(30) Foreign Application Priority Data

Dec. 20, 2016 (CN) ..... 2016 1 1188394

(51) Int. Cl.
*G09G 3/36* (2006.01)
*G09G 5/06* (2006.01)

(52) U.S. Cl.
CPC ..... *G09G 3/3607* (2013.01); *G09G 3/3611* (2013.01); *G09G 5/06* (2013.01);
(Continued)

(58) Field of Classification Search
CPC ..... G09G 5/026; G09G 5/02; G02F 2001/13435; G02F 2340/06;
(Continued)

(56) References Cited

U.S. PATENT DOCUMENTS

2012/0105500 A1 5/2012 Wu et al.
2012/0113379 A1* 5/2012 Tomizawa ..... G09G 3/3607 349/187

(Continued)

FOREIGN PATENT DOCUMENTS

CN 104680993 A 6/2015
CN 104900203 A 9/2015
CN 106782371 A 5/2017

OTHER PUBLICATIONS

International Search Report and Written Opinion, dated Sep. 27, 2017, from International Application No. PCT/CN2017/086131, filed on May 26, 2017. Twelve pages.

*Primary Examiner* — Nitin Patel
*Assistant Examiner* — Amen Woldesenbet Bogale
(74) *Attorney, Agent, or Firm* — HoustonHogle LLP

(57) ABSTRACT

A method for driving a display panel includes: dividing pixels on the display panel into a plurality of pixel groups; each of the pixel groups includes an even number of pixels arranged in arrays; calculating an average gray scale value of blue sub-pixels in each of the sub-pixel groups according to an image input signal; obtaining two groups of target gray scale value pairs according to the average gray scale value; each group of the target gray scale value pair includes a high gray scale value and a low gray scale value; a brightness of
(Continued)

the high gray scale value and the low gray scale value in the front view is the same as a brightness of the average gray scale value in the front view; obtaining corresponding two groups of driving voltage pairs according to the two groups of the target gray scale value pairs in each of the pixel groups; driving the blue sub-pixels on the corresponding pixel group according to the two groups of the driving voltage pairs.

14 Claims, 7 Drawing Sheets

(52) U.S. Cl.
CPC ..... *G09G 2300/0439* (2013.01); *G09G 2300/0452* (2013.01); *G09G 2320/028* (2013.01); *G09G 2320/0242* (2013.01); *G09G 2320/04* (2013.01)

(58) Field of Classification Search
CPC ..... G02F 2340/0428; G02F 2310/027; G02F 2360/16; G02F 2360/145; G02F 2330/028; G06T 1/20; H04N 9/64
See application file for complete search history.

(56) References Cited

U.S. PATENT DOCUMENTS

2015/0364526 A1* 12/2015 Peng ..... H01L 27/3216 257/40
2016/0163277 A1* 6/2016 Ludden ..... G09G 3/3688 345/690
2017/0018238 A1* 1/2017 Kang ..... G09G 3/2003

* cited by examiner

DISPLAY APPARATUS AND METHOD FOR DRIVING DISPLAY PANEL THEREOF

CROSS REFERENCE TO RELATED APPLICATION

This application is a § 371 National Phase Application of International Application No. PCT/CN2017/086131, filed on May 26, 2017, which claims priority to Chinese Patent Application No. 201611188394.3, entitled "LIQUID CRYSTAL DISPLAY APPARATUS AND METHOD FOR DRIVING LIQUID CRYSTAL DISPLAY PANEL THEREOF" filed on Dec. 20, 2016, the contents of which are expressly incorporated by reference herein in its entirety.

FIELD OF THE INVENTION

The present disclosure relates to a field of liquid crystal display (LCD) technology, and particularly relates to a display apparatus and a method for driving a display panel thereof.

BACKGROUND OF THE INVENTION

Most conventional large-sized display apparatuses adopt negative vertical alignment (VA) liquid crystal technology or in-plane switching (IPS) liquid crystal technology. As to the driving of a VA liquid crystal in a large viewing angle, the brightness is rapidly saturated with the driving voltage, so that the viewing angle color shift is serious and the quality of the image is affected. Since a tendency of brightness saturation of a blue sub-pixel in the side view with the increasing of the gray scale is rapider and more pronounced than that of a red sub-pixel and a green sub-pixel, the quality of an image will show a significant deficiency of blue color shift in the mixed color view.

SUMMARY

According to various embodiments of the present disclosure, a display apparatus and a method for driving a display panel thereof are provided, which can improve the deficiency of viewing angle color cast.

A method for driving a display panel includes:

dividing pixels on a display panel into a plurality of pixel groups; each of the pixel groups comprises an even number of pixels arranged in arrays;

calculating an average gray scale value of blue sub-pixels in each of the sub-pixel groups according to an image input signal;

obtaining two groups of the target gray scale value pairs according to the average gray scale value; each group of the target gray scale value pair includes a high gray scale value and a low gray scale value; a brightness of the high gray scale value and the low gray scale value in the front view is the same as a brightness of the average gray scale value in the front view;

obtaining corresponding two groups of the driving voltage pairs according to the two groups of the target gray scale value pairs in each of the pixel groups; and driving the blue sub-pixels on the corresponding pixel group according to the two groups of the driving voltage pairs.

According to an embodiment, each of the pixel groups includes four pixels arranged in arrays.

According to an embodiment, in the step of obtaining the two groups of the target gray scale value pairs according to the average gray scale value, the two groups of the target gray scale value pairs are obtained via a gray scale value Look Up Table (LUT); each of gray scale values in the gray scale value LUT corresponds to the two groups of the target gray scale value pairs.

According to an embodiment, the method further includes a step of prestoring the gray scale value LUT.

According to an embodiment, the step of obtaining the two groups of the target gray scale value pairs according to the average gray scale value includes:

determining a gray scale range of the average gray scale value of the blue sub-pixels in each of the pixel groups;

obtaining the corresponding gray scale value LUT according to the gray scale range in each of the pixel groups; and obtaining the corresponding two groups of the target gray scale value pairs using the corresponding gray scale value LUT according to the average gray scale value of the blue sub-pixels in each of the pixel groups.

According to an embodiment, the method further includes a step of prestoring a correspondence table between various gray scale value ranges and the gray scale value LUTS.

According to an embodiment, the step of obtaining corresponding two groups of the driving voltage pairs according to the two groups of the target gray scale value pairs in each of the pixel groups is: obtaining the corresponding two groups of the driving voltage pairs using a driving voltage LUT according to the two groups of the target gray scale value pairs in each of the pixel groups.

According to an embodiment, the method further includes a step of prestoring the driving voltage LUT.

According to an embodiment, in the step of driving the blue sub-pixels on the corresponding pixel group according to the two groups of the driving voltage pairs, the driving voltages of two adjacent blue sub-pixels are different.

A display apparatus includes:

a display panel, pixels on the display panel are divided into a plurality of pixel groups; and each of the pixel groups includes an even number of pixels arranged in arrays;

a control element including one or more processors, and a memory storing computer executable instructions, which, when executed by the one or more processors cause the one or more processors to perform the steps of following units:

a calculating unit used to receive an image input signal, and calculate an average gray scale value of the blue sub-pixels in each of the pixel groups according to the image input signal; and an obtaining unit used to obtain two groups of the target gray scale value pairs according to the average gray scale value; each group of the target gray scale value pair includes a high gray scale value and a low gray scale value; a brightness of the high gray scale value and the low gray scale value in the front view is the same as a brightness of the average gray scale value in the front view;

the obtaining unit is further used to obtain corresponding two groups of the driving voltage pairs according to the two groups of the target gray scale value pairs in each of the pixel groups; and a driving element respectively connected to the control element and the display panel, the driving element is used to drive the blue sub-pixels on the corresponding pixel group according to the two groups of the driving voltage pairs.

According to an embodiment, each of the pixel groups includes four pixels arranged in arrays.

According to an embodiment, the obtaining unit is used to obtain the corresponding two groups of the target gray scale value pairs using a gray scale value LUT according to the average gray scale value; and each of gray scale values in the gray scale value LUT corresponds to the two groups of the target gray scale value pairs.

According to an embodiment, the display apparatus further includes a storing element, the storing element is used to store the gray scale value LUT.

According to an embodiment, when the computer executable instructions are executed by the one or more processors, the one or more processors execute the step in the determining unit; and the determining unit is used to determine a gray scale range of the average gray scale value of the blue sub-pixels in each of the pixel groups;

the obtaining unit is used to obtain the corresponding gray scale value LUT according to the gray scale range in each of the pixel groups, and obtain the corresponding two groups of the target gray scale value pairs using the corresponding gray scale value LUT according to the average gray scale value of the blue sub-pixels in each of the pixel groups;

According to an embodiment, the storing element is further used to store a correspondence table between the respective gray scale ranges and the gray scale value LUTS.

According to an embodiment, the storing element is further used to store a driving voltage LUT; and the obtaining unit is used to obtain the corresponding two groups of the driving voltage pairs using the driving voltage LUT according to the two groups of the target gray scale value pairs in each of the pixel groups.

According to an embodiment, when the driving element drives the blue sub-pixels on the corresponding pixel group according to the two groups of the driving voltage pairs, the driving voltages controlling the two adjacent blue sub-pixels are different.

According to an embodiment, the display panel is a flat display panel or a curved display panel.

A display apparatus includes:

a display panel, pixels on the display panel are divided into a plurality of pixel groups; and each of the pixel groups includes four pixels arranged in arrays;

a control element including one or more processors, and a memory storing computer executable instructions, which, when executed by the one or more processors cause the one or more processors to perform the steps of following units:

a calculating unit used to receive an image input signal, and calculate an average gray scale value of blue sub-pixels in each of the pixel groups according to the image input signal; and a determining unit used to determines a gray scale range of the average gray scale value of the blue sub-pixels in each of the pixel groups;

and an obtaining unit used to obtain a corresponding gray scale value LUT according to the gray scale range in each of the pixel groups, and obtain two groups of the target gray scale value pairs using the corresponding gray scale value LUT according to the average gray scale value of the blue sub-pixels in each of the pixel groups; each group of the target gray scale value pair include a high gray scale value and a low gray scale value; a brightness of the high gray scale value and the low gray scale value in the front view is the same as a brightness of the average gray scale value in the front view;

the obtaining unit is further used to obtain corresponding two groups of the driving voltage pairs according to the two groups of the target gray scale value pairs in each of the pixel groups; and a driving element connected to the control element and the display panel, respectively, and the driving element is used to drive the blue sub-pixels on the corresponding pixel group according to the two groups of the driving voltage pairs.

According to the aforementioned display apparatus and the method for driving the display panel thereof, two groups of the target gray scale value pairs are obtained according to the average gray scale value in each of the pixel groups on the display panel. Each group of the target gray scale value pair includes the high gray scale value and the low gray scale value, and the brightness of their mixture in the front view is the same as the brightness of the average gray scale value in the front view, so that the brightness would not be affected. The corresponding two groups of the driving voltage pairs are obtained according to the two groups of the target gray scale value pairs, thereby enabling each of the pixel groups to have two groups of the driving voltage pairs that improve the viewing angle color shift. Since different driving voltage pairs have different improvement effect on the color shift of the different gray scale value ranges, the brightness of the blue sub-pixels can be proximal to the effect in the front view as the gray scale value changes. Such that the deficiency of color shift caused by premature saturation of blue sub-pixel in the large view can be effectively improved.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. The accompanying drawings in the following description are only some embodiments of the present invention, and persons of ordinary skill in the art can derive other obvious variations from the accompanying drawings without creative efforts.

DETAILED DESCRIPTION OF THE EMBODIMENTS

Embodiments of the present disclosure are described more fully hereinafter with reference to the accompanying drawings, in which some embodiments of the present disclosure are shown. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Figure 1:
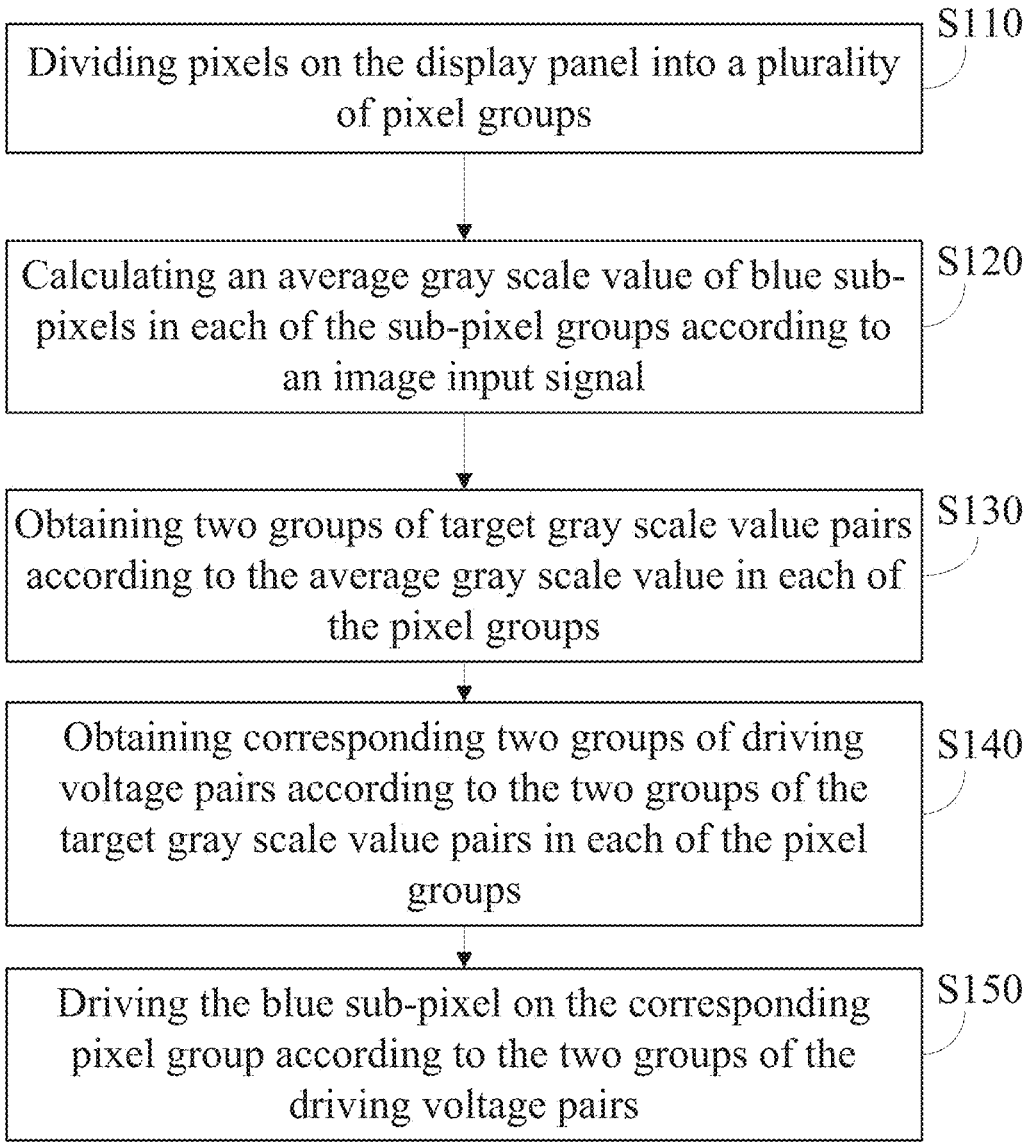
FIG. 1 is a flowchart of a method for driving a display panel according to an embodiment.

FIG. 1 is a flowchart of a method for driving a display panel according to an embodiment. The method for driving the display panel can improve the deficiency of color shift (or color aberration) caused by refractive index mismatch of the liquid crystal in the large view and especially can effectively improve the deficiency of color shift caused by premature saturation of the blue sub-pixels in a large viewing angle. The display panel can be a liquid crystal display (LCD) panel, an organic light emitting diode (OLED) display panel, a quantum light emitting diode (QLED) display panel and so on, whilst the display panel can be a flat display panel or a curved display panel. It should be noted that the display panel includes the aforementioned examples but is not limited thereto. When the display panel is the LCD panel, it can be the LCD panel such as a twisted nematic (TN), an optically compensated bend (OCB), or a vertical alignment (VA) panel. Referring to FIG. 1, the method for driving the display panel includes the following steps:

In step S110, pixels on a display panel are divided into a plurality of sub-pixel groups.

Figure 2:
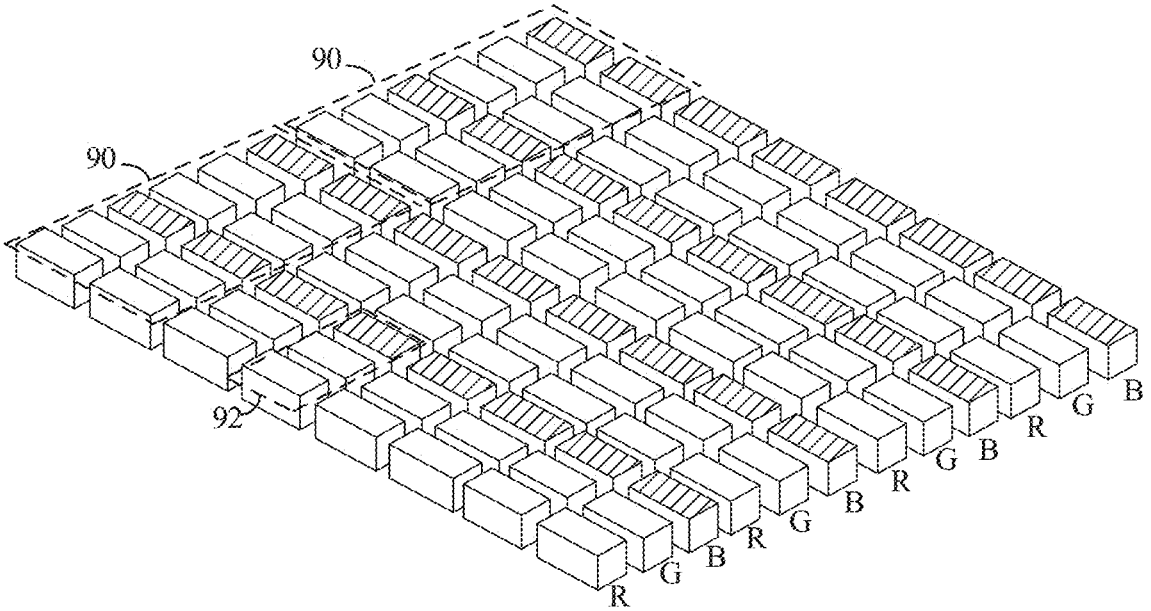
FIG. 2 is a schematic diagram of dividing pixels after step S110 of FIG. 1 is performed.

After division, each of the pixel groups includes an even number of pixels arranged in arrays. In the illustrated embodiment, each of the pixel groups 90 includes four pixels arranged in arrays, as shown in FIG. 2. Each pixel 92 includes a red sub-pixel R, a green sub-pixel G, and a blue sub-pixel B, i.e., each of the pixel groups 90 includes four blue sub-pixels arranged in arrays. In an alternative embodiment, the number of the pixels included in each of the pixel groups can be configured as required.

In step S120, an average gray scale value of blue sub-pixels in each of the sub-pixels is calculated according to an image input signal.

The gray scale value of each of the blue sub-pixels is represented by $B_{i,j}$, where B represents blue, (i, j) represents a serial number of the blue sub-pixels in the entire display panel. The average gray scale value B'n of the blue sub-pixels in each of the sub-pixel groups is calculated as follows:

$$B'n=\text{Average}(B_{i,j}+B_{i+1,j}+B_{i,j+1}+B_{i+1,j+1})$$

In step S130, two groups of the target gray scale value pairs are obtained according to the average gray scale value in each of the pixel groups.

Each group of the target gray scale value pair includes a high gray scale value and a low gray scale value. The high gray scale value and the low gray scale value are required that a brightness after the two are mixed in the front view is the same as a brightness of the average gray scale value B'n in the front view. According to an embodiment, a large viewing angle brightness corresponding to the high gray scale value and the low gray scale value should be proximal to a front viewing angle brightness of the average gray scale value thereof as much as possible. According to an embodiment, a difference between the high gray scale value and the low gray scale value of the target gray scale value pair needs to be greater than a preset difference range, therefore ensuring that the two gray scale values of the target gray scale pair have a large gray scale difference. Two groups' target gray scale pairs have different viewing angle color shift improvement ranges. The viewing angle color shift improvement range of one group is poorer than that of the other group, i.e., one of them can have a greater improving effect on the color shift of the high gray scale value in the large viewing angle, and another group can have a greater improving effect on the color shift of the low gray scale value in the large viewing angle. In the illustrated embodiment, the high gray scale value is relative to the low gray scale value of the other group. The large viewing angle can be defined as greater than 60°, or customized according to a user. The target gray scale value pair can be obtained via a gray scale value Look Up Table (LUT). Specifically, each of gray scale values in the gray scale value LUT corresponds to the two groups of the target gray scale value pairs. The gray scale value LUT is shown as follows according to an embodiment:

| Inputted gray | A first group of target gray scale value pairs | | A second group of target gray scale value pairs | |
|---|---|---|---|---|
| scale value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

The aforementioned gray scale value LUT is merely an example and shouldn't be construed as limited to the specific gray scale value LUT. The color shift improvement ranges of the two groups of the target gray scale value pairs in each of the gray scale value LUTS don't overlap as much as possible, thereby ensuring that the brightness of the blue sub-pixels varying with the gray scale value is approximate to the effect in the front view from the low gray scale value to the high gray scale value. Such that the deficiency of color shift caused by premature saturation of blue sub-pixels in the large viewing angle can be effectively improved. The gray scale value LUT can be prestored in a storing element. Thus, the corresponding two groups of the target gray scale value pairs can be readily obtained according to the average gray scale value.

Figure 3:
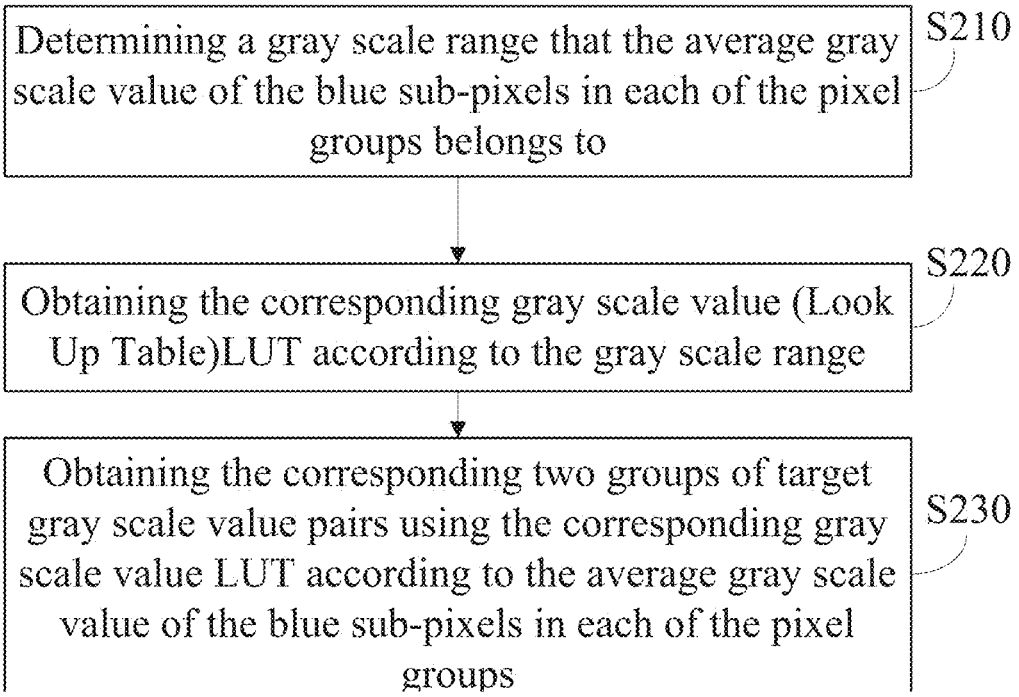
FIG. 3 is a specific flowchart of step S130 in FIG. 1.

According to an embodiment, the process of obtaining the two groups of the target gray scale value pairs includes the following steps, as shown in FIG. 3.

In step 210, a gray scale range of the average gray scale value of the blue sub-pixels in each of the pixel groups is determined.

Prior to determining the gray scale range of the average gray scale value, the gray scale values of the blue sub-pixels are divided into a preset number of gray scale ranges beforehand, e.g., 0 to 50, 51 to 101, 102 to 152, 153 to 203, and 204 to 255. It should be noted that the gray scale range can be divided according to an actual requirement but is not limited thereto. Each of the gray scale ranges can be determined according to the extent to which the color cast needs to be improved. The dividing of the different gray scale ranges will be prestored in the storing element, which can be obtained in the LUT.

In step 220, the corresponding gray scale value LUT is obtained according to the gray scale range.

The different gray scale ranges have different effects on the viewing angle color shift, so that the different gray scale ranges correspond to the different gray scale value LUTS. Therefore, the different gray scale values can be driven by a more suitable target gray scale value pair corresponding to the gray scale range, and the target gray scale value pair corresponds to a driving voltage, which ensures that the brightness of the adjusted blue sub-pixels varying with gray scale in the side view is more approximate to the variation curve in the front view. A correspondence table between the respective gray scale value ranges and the gray scale value LUTS can be stored in the storing element beforehand. The corresponding driving voltage can be readily determined according to the obtained gray scale range.

For example, when the average gray scale value belongs to 0 to 50, a gray scale value LUT1 is adopted, which is shown as in the following table:

| Inputted gray | A first group of target gray scale value pairs | | A second group of target gray scale value pairs | |
|---|---|---|---|---|
| scale value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

When the average gray scale value belongs to 51 to 100, a gray scale value LUT2 is adopted, which is shown as in the following table:

| Inputted average | A third group of target gray scale value pairs | | A fourth group of target gray scale value pairs | |
|---|---|---|---|---|
| value | BH1 | BL1 | BH2 | BL2 |
| 0 | 0 | 0 | 0 | 0 |
| 1 | 40 | 0 | 33 | 0 |
| 2 | 75 | 0 | 78 | 10 |
| 3 | 130 | 5 | 90 | 35 |
| 4 | 180 | 15 | 120 | 45 |
| 5 | 200 | 35 | 160 | 65 |
| . | . | . | . | . |
| . | . | . | . | . |
| . | . | . | . | . |
| 255 | 255 | 160 | 255 | 160 |

Likewise, the aforementioned is merely a specific example, the range division of the gray scale value LUTs and the respective gray scale value LUTs are not limited to the described implementations of the aforementioned embodiment.

In step S230, the corresponding two groups of the target gray scale value pairs are obtained by using the corresponding gray scale value LUT according to the average gray scale value of the blue sub-pixels in each of the pixel groups.

As aforementioned, the corresponding two groups of the target gray scale value pairs are readily obtained by looking up the table according to the obtained average gray scale value and the gray scale value LUT.

In step S140, the corresponding two groups of driving voltage pairs are obtained according to the two groups of the target gray scale value pairs in each of the pixel groups.

There is a one-to-one correspondence between the driving voltage and the gray scale value, and a corresponding driving voltage can thus be obtained according to the gray scale value. The corresponding two groups' driving voltage ($B_{n'_H1}$ and $B_{n'_L1}$, $B_{n'_H2}$ and $B_{n'_L2}$) can be readily determined according to the two groups of the target gray scale value pairs. In the illustrated embodiment, since the one-to-one correspondence exists between the driving voltage and the gray scale value, a high driving voltage and a low driving voltage also exist in the driving voltage pair. The driving voltage pair can be obtained by looking up a table via a driving voltage LUT. The driving voltage LUT is a table of correspondence between a color gray scale value of the input signal of the blue sub-pixel and the driving voltage. Specifically, each of the gray scale values of the blue sub-pixel corresponds to a driving voltage signal.

Figure 4:
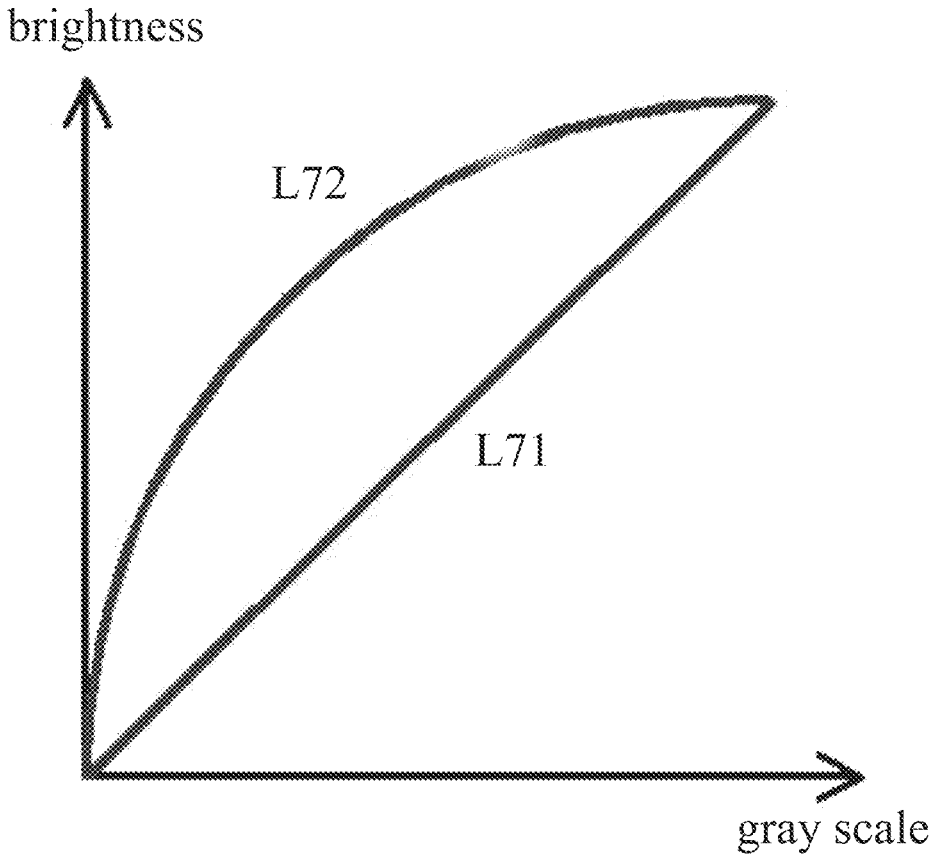
FIG. 4 is a graphic diagram illustrating a comparison of curves of brightness of the blue sub-pixels varying with gray scale in the front view and in the side view when adopting a single driving voltage to perform the driving.
Figure 5:
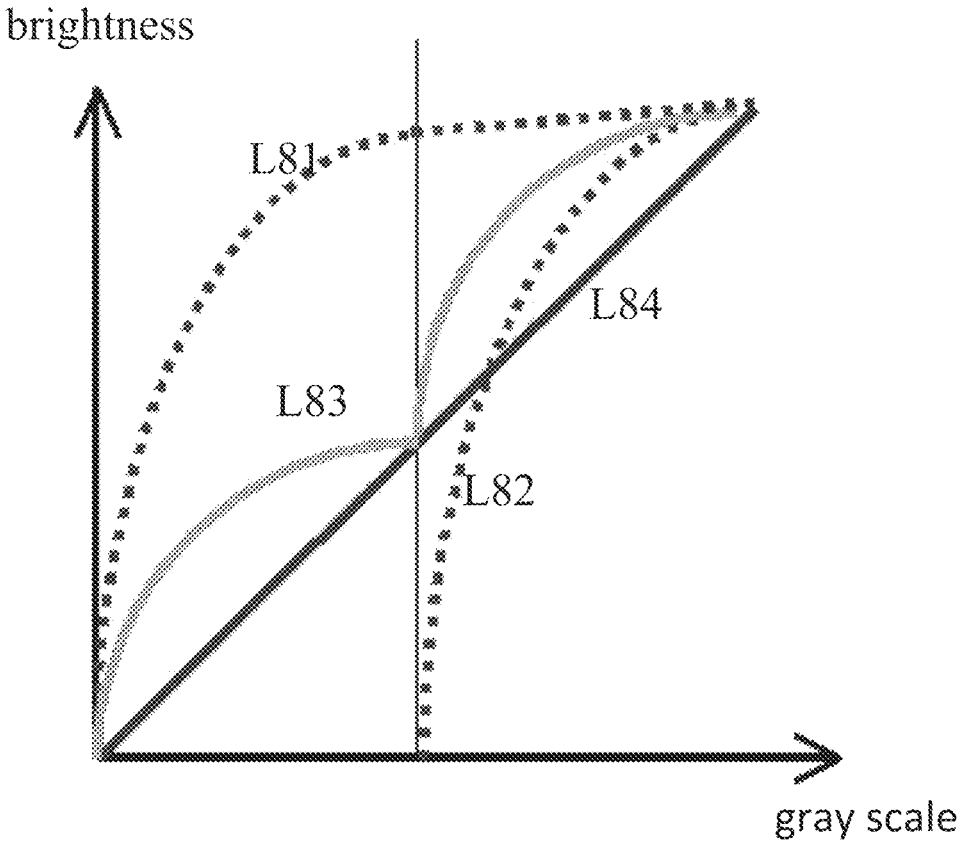
FIG. 5 is a graphic diagram illustrating curves of the brightness of the blue sub-pixel varying with the gray scale in the side view when adopting a high driving voltage, a low driving voltage, and a high and low driving voltage pair to perform the driving, respectively.

Each group of the high and low driving voltages are capable of making a curve of brightness of the adjusted blue sub-pixels varying with the gray scale in the side view more approximate to that in the front view. By driving the blue sub-pixels in each of the sub-pixel groups via the high and low voltages, the brightness variation of the blue sub-pixels in the side view can be controlled. Therefore a saturation tendency of the blue sub-pixel in the side view is approximate to the red sub-pixels and the blue sub-pixels or is approximate to a tendency of brightness saturation curves of the red sub-pixels, green sub-pixels, and the blue sub-pixels in the front view, thereby reducing the deficiency of the viewing color shift. FIG. 4 is a curve of the brightness of the blue sub-pixels varying with the gray scale value in the front view and in the side view when a single driving voltage is adopted. Specifically, L71 represents a curve in the front view, and L72 represents a curve in the side view. Apparently, it is easy that the curve of the brightness of the blue sub-pixel varying with the gray scale value tends to be saturated easily in the side view, so that the quality of an image will show a significant deficiency of a bluish color shift in the mixed color view. FIG. 5 is a graphic diagram illustrating a comparison of the brightness variation curves in the side view when a high voltage driving and a low voltage driving are adopted, and when a high and low driving voltage pair is adopted to perform the driving. Specifically, L81 is a curve of brightness varying with the gray scale in the side view when a high voltage is used to drive. L82 is a curve of brightness varying with the gray scale in the side view when a low voltage is used to drive. L83 is a combination of L81 and L82, i.e., a curve of brightness varying with the gray scale after the high and low driving voltage pair is adopted, which is apparently more approximate to the curve L84 of the brightness varying with the gray scale in the front view, i.e., the viewing angle color shift is improved after the high and low voltage pair is adopted.

Since different driving voltage pairs have different improvement effects on the viewing angle color shift of the different gray scale value ranges, there must be one group of driving voltage pairs corresponding to the high gray value in the two groups of the driving voltage pairs, while the other group of driving voltage pairs corresponds to the low gray scale value. Therefore, in each of the pixel groups, there is a driving voltage pair that can improve the color shift of the high gray scale value in a large viewing angle, and a driving voltage pair that can improve the color shift of the low gray scale value in the large viewing angle, such that, from the low gray scale value to the high gray scale value, the brightness of the blue sub-pixels varying with the gray scale value is approximate to the effect in the front view, and the deficiency of color shift caused by premature saturation of blue sub-pixels in the large view can be effectively improved.

In step S150, the blue sub-pixels on the corresponding pixel group are driven according to the two groups of the driving voltage pairs.

Figure 6:
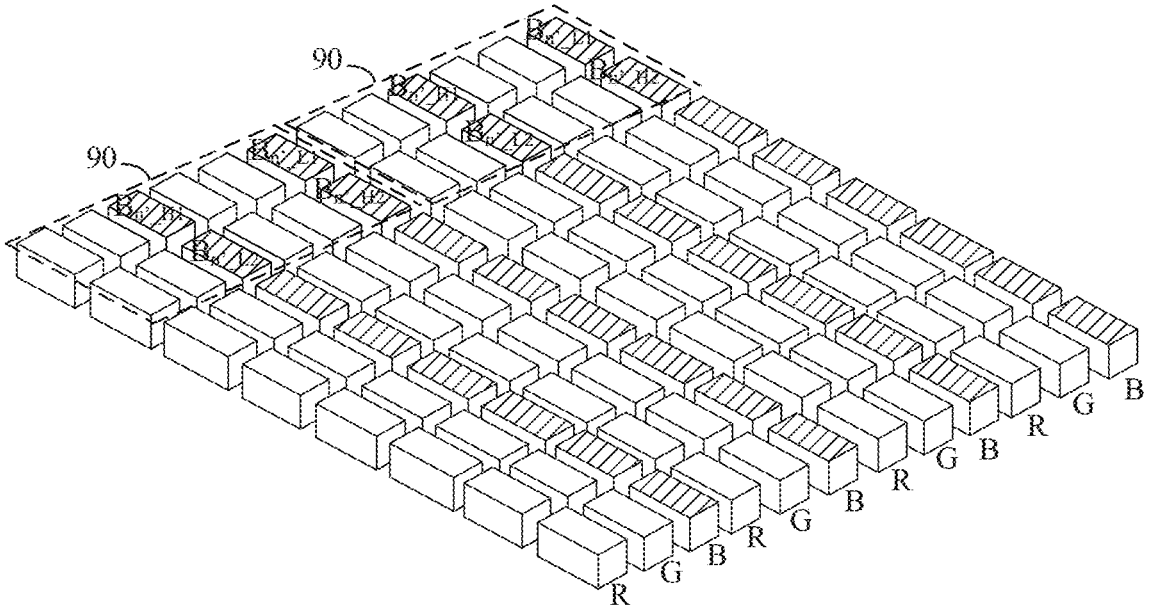
FIG. 6 is a schematic diagram illustrating driving after step S150 is performed.

Specifically, the blue sub-pixels on the corresponding pixel group are respectively driven by the two groups of the driving voltage pairs ($B_{n'_H1}$ and $B_{n'_L1}$, $B_{n'_H2}$ and $B_{n'_L2}$) in the process of driving, such that the driving voltages of two adjacent sub-pixels are different, and the deficiency of viewing angle color shift can be improved by the interphase driving of the high and low voltages, as shown in FIG. 6.

According to the aforementioned method for driving the display panel, the two groups of the target gray scale value pairs are obtained according to the average gray scale value in each of the pixel groups on the display panel. Each group of the target gray scale value pair includes a high gray scale value and a low gray scale value, and the brightness after the two are mixed in the front view is the same as the brightness of the average gray scale value in the front view, thereby having no effect on the brightness. The corresponding two groups of the driving voltage pairs are obtained according to the two groups of the target gray scale value pairs, therefore there are two groups of the driving voltage pairs improving the viewing angle color shift in each of the pixel groups. Since the different driving voltage pairs have different improvement effects on the viewing angle color shift in different gray scale value ranges, from the low gray scale value to the high gray scale value after mixing, the brightness of the blue sub-pixels varying with the gray scale value is approximate to the effect in the front view, such that the deficiency of color shift caused by premature saturation of blue sub-pixels in the large view can be effectively improved. Moreover, after the aforementioned driving method is adopted, the pixels on the display panel need not be designed as a primary pixel and a secondary pixel, thereby greatly improving the penetration and resolution of a thin film transistor (TFT) display panel, and reducing the design costs of backlight.

Figure 7:
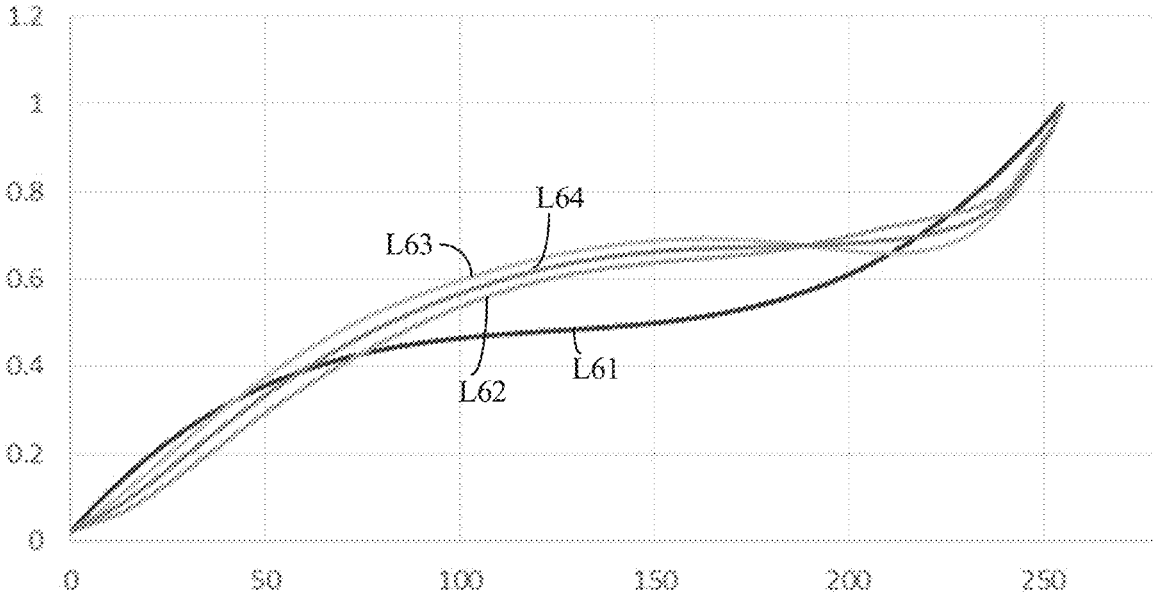
FIG. 7 is a graphic diagram illustrating a comparison of a curve of ideal brightness varying with the gray scale and curves of a respective brightness of two voltages combination varying with the gray scale.
Figure 8:
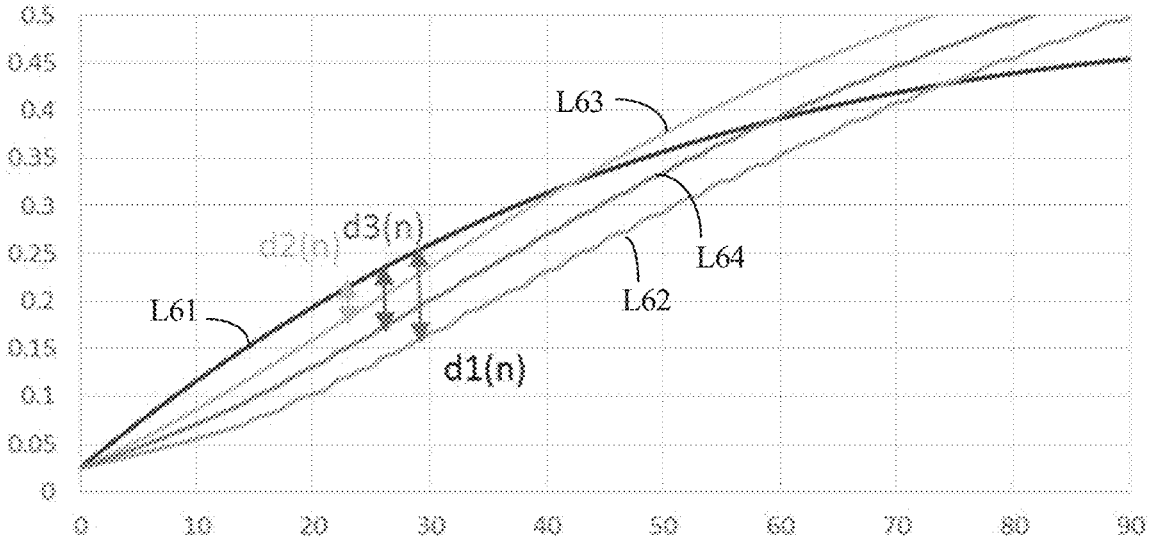
FIGS. 8 and 9 are partial enlarged views of FIG. 7.
Figure 9:
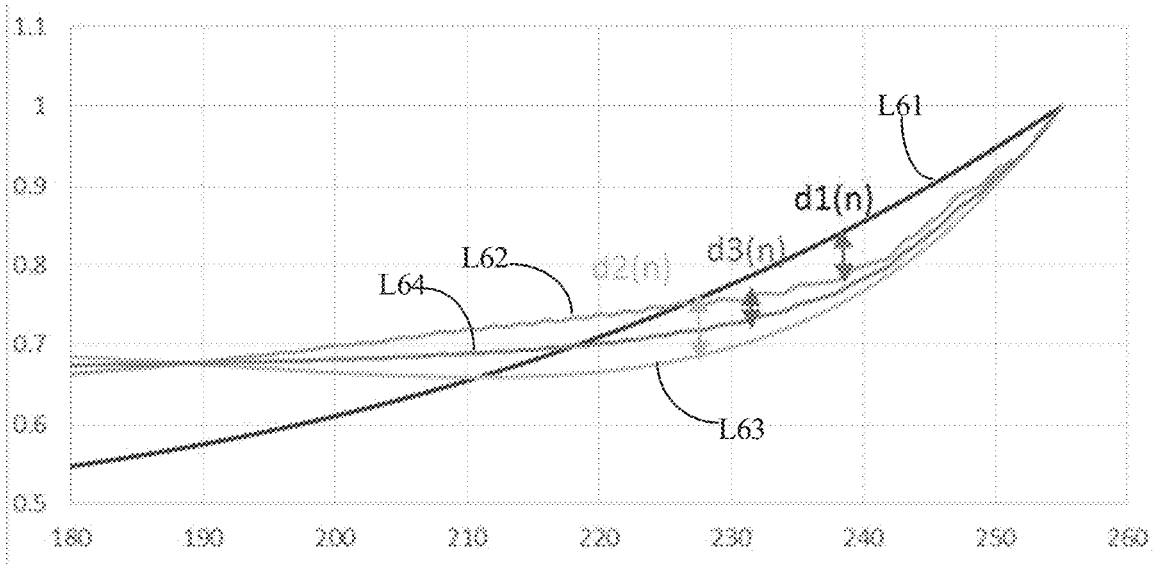

The improvement effect of the color shift of a driving method in the illustrated embodiment will be described with reference to the FIGS. 7 to 9 hereinafter. Referring to FIG. 7, target gamma is a curve of brightness of a target blue sub-pixel varying with the gray scale value, which corresponds to L61 in FIG. 7. The dividing of the blue sub-pixel space has to satisfy a condition that the ratio of the RGB brightness does not change in the front view. There are several combinations of high and low voltage signals divided by the blue sub-pixel space, and the condition that the brightness saturation varying with the voltage in the side view caused by each combination is different. Referring to FIG. 7, the high and low voltage combinations, gamma1 and gamma2, which are divided by the blue sub-pixel space and for which the brightness is saturated and varies with voltage in the side view correspond to L62 and L63 in the drawing, respectively. FIGS. 8 and 9 are partial enlarged views of the FIG. 7. It can be seen from the FIGS. 7 to 9, when a group of a high and low voltage pair is adopted to drive the blue sub-pixels on the display panel, the saturation tendency of the curve of the brightness varying with the gray scale is rapider than that of the Target gamma, and therefore the problem of the side viewing angle color shift cannot be satisfactorily solved, i.e., the combination of the high voltage and the low voltage merely divided by one blue sub-pixel space cannot satisfy the requirement that the brightness of the high and low voltages is approximate to the target brightness at the same time.

As shown in FIG. 8, when a relation of variation between the low voltage (corresponding to the low gray scale value) and the brightness is considered, the difference d1($n$) between the actual brightness of the gamma1 and the target brightness is much larger than the difference d2($n$) between the actual brightness of the gamma2 and the target brightness. However, as shown in FIG. 9, when a relation of variation between the high voltage and the brightness is considered, the difference d1 ($n$) between the actual brightness of the gamma1 and the target brightness is much smaller than the difference d2 ($n$). That is, the gamma 1 is suitable for a condition when the blue sub-pixel higher voltage signal (i.e., the gray scale value of the blue sub-pixels is higher) is presented on the image content. On the other hand, the gamma2 is suitable for a condition when the blue sub-pixel lower voltage signal (i.e., the gray scale value of the blue subpixels is low) is presented on the image content. According to the driving method of the illustrated embodiment, each of the pixel groups includes the driving voltage pair that is suitable for the high gray scale value, and the driving voltage pair that is suitable for the low gray scale value. Therefore, a curve of the viewing angle brightness variation that is generated by the combination of the two groups of the driving voltage pairs combines the advantages of both, and then makes a viewing angle curve more approximate to the demand of a target value. Therefore, the curve changes are smoother, the phenomenon of color mutation and abnormal mixed color of image quality will not occur. In the FIGS. 7 to 9, gamma 3 (corresponding to L64 in the FIGS. 7 to 9) is a viewing angle brightness curve which is generated by, e.g., the high and the low voltage combination of gamma 1 and gamma 2. Apparently, the difference d3 ($n$) between the actual brightness of the gamma3 and the target brightness is always between d1 ($n$) and d2 ($n$), i.e., the change of which is more approximate to the demand of the target value, thereby effectively improving the viewing angle color shift.

Figure 10:
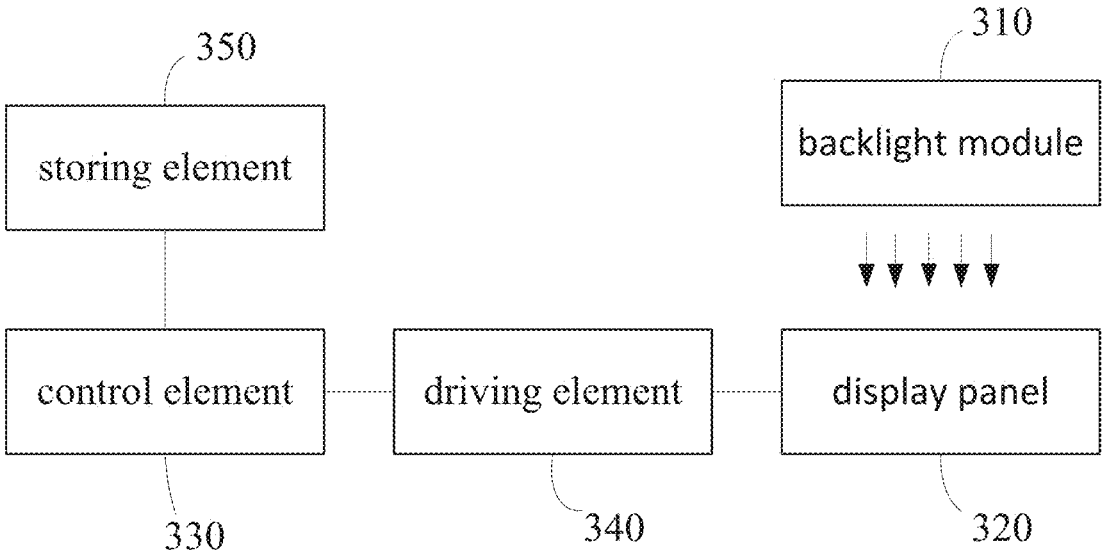
FIG. 10 is a block diagram of a display apparatus according to an embodiment.

The present disclosure also provides a display apparatus, as shown in FIG. 10. The display apparatus can perform the aforementioned driving method. The display apparatus includes a backlight module 310, a display panel 320, a control element 330, and a driving element 340. Specifically, the control element 330 and the driving element 340 can be both integrated into the display panel 310, however, the backlight module 310 can be implemented by adopting an independent backlight module, directly. It should be noted that the manner of integrating the respective elements is not limited thereto. In an alternative embodiment, the display apparatus may not include the backlight module 310.

The backlight module 310 is used to provide the backlight. The backlight module 310 can be direct-lit backlight or side-lit backlight. The backlight source can be a white light source, a RGB three color light source, a RGBW four color light source or a RGBY four color light source, but is not limited thereto.

The display panel 320 can be a liquid crystal display (LCD) panel, an organic light emitting diode (OLED) display panel, a quantum light emitting diode (QLED) display panel and so on, and, at the same time, the display panel 320 can be a flat display panel or a curved display panel. It should be noted that the display panel 320 includes the aforementioned examples but is not limited thereto. When the display panel 320 is the LCD panel, it can be an LCD panel such as the TN, the OCB, or the VA apparatus. In the illustrated embodiment, the pixels on the display panel 320 are divided into a plurality of sub-pixel groups. Each of the pixel groups includes an even number of pixels arranged in arrays. In the illustrated embodiment, each of the pixel groups includes four pixels arranged in arrays, i.e., includes four blue sub-pixels arranged in arrays, as shown in FIG. 2.

Figure 11:
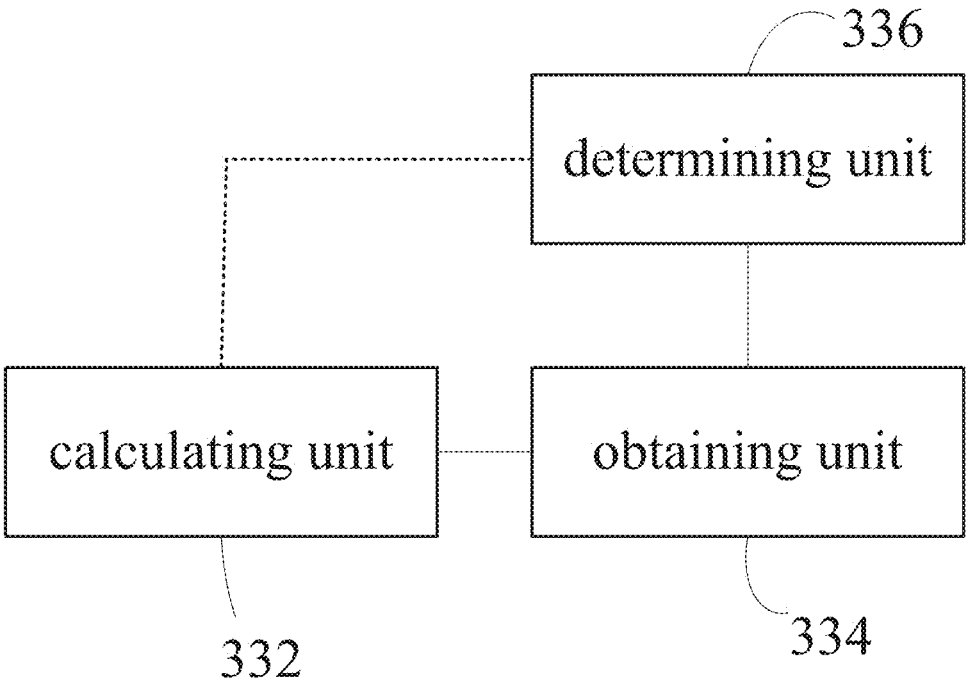
FIG. 11 is a block diagram of a control element according to an embodiment.

The control element 330 includes one or more processors, and a memory storing computer executable instructions, which, when executed by the one or more processors cause the one or more processors to perform the steps of the following units as shown in FIG. 11. A calculating unit 334 is used to receive an image input signal, and calculate an average gray scale value of blue sub-pixels in each of the pixel groups according to the image input signal. The calculating unit 332 is further used to obtain two groups of the target gray scale value pairs according to the average gray scale value. Each group of the target gray scale value pairs includes a high gray scale value and a low gray scale value. A brightness of the high gray scale value and the low gray scale value in the front view is the same as a brightness of the corresponding average gray scale value in the front view. The target gray scale value pair can be obtained via a gray scale value LUT. Each of gray scale values in the gray scale value LUT corresponds to the two groups of the target gray scale value pairs. Therefore, the two groups of the target gray scale value pairs corresponding thereto can be obtained via the gray scale value LUT according to the obtained average gray scale value. According to an embodiment, the display apparatus further includes a storing element 350, which is used to store the gray scale value LUT.

According to an embodiment, when the computer executable instructions are executed by the one or more processors, the one or more processors execute the step in a determining unit 336. The determining unit 336 is used to determine a gray scale range of the average gray scale value in each of the pixel groups. The obtaining unit 334 is further used to obtain a gray scale value LUT according to the gray scale range, and obtain two groups of the target gray scale value pairs using the corresponding gray scale value LUT according to two groups of the target gray scale value pairs in each of the sub-pixel groups. In the illustrated embodiment, the storing element 350 can store the respective gray scale ranges, a correspondence relation between the respective gray scale ranges and the gray scale value LUT, and the gray scale value LUT corresponding to the respective gray scale ranges beforehand. The obtaining unit 334 is further used to obtain corresponding two groups of the driving voltage pairs according to the two groups of the target gray scale value pairs in each of the pixel groups.

The driving element 340 is connected to the control element 330 and the display panel 320, respectively. The driving element 340 is used to drive the blue sub-pixels of the corresponding sub-pixel group according to the two groups of the driving voltage pairs. Specifically, when the driving element 340 performs driving, the driving voltages controlling two adjacent blue sub-pixels are different, and therefore each of the pixel groups is driven by high and low interphase voltages.

According to the aforementioned display apparatus, two groups of the target gray scale value pairs are obtained according to the average gray scale value in each of the pixel groups on the display panel. Each group of the target gray scale value pairs include the high gray scale value and the low gray scale value, and the brightness after the two are mixed in the front view is the same as the brightness of the average gray scale value in the front view, without affecting the brightness. The corresponding two groups of the driving voltage pairs are obtained according to the target gray scale value pairs, such that there are two groups of the driving voltage pairs improving the viewing angle color shift in each of the pixel groups. Since the different driving voltage pairs have different improvement effects on the viewing angle color shift of the different gray scale value ranges, from the low gray scale value to the high gray scale value after mixing, the brightness of the blue sub-pixels varying with the gray scale value is approximate to the effect in the front view, such that the deficiency of color shift caused by premature saturation of blue sub-pixels in the large view can be effectively improved.

Those of ordinary skills in the art can understand that the total or partial process of the aforementioned method can be achieved by an associated hardware instructed by a computer program. The program may be stored in a computer-readable storage medium. When the program is executed, the program can include the aforementioned process of the aforementioned embodiment of the methods. The storage medium may be a nonvolatile storage medium such as a magnetic disk, an optical disk, a read-only memory (ROM), or a random access memory (RAM).

The different technical features of the above embodiments can have various combinations which are not described for the purpose of brevity. Nevertheless, to the extent the combining of the different technical features does not conflict with each other, all such combinations must be regarded as within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A method for driving a display panel, comprising:

dividing pixels on the display panel into a plurality of pixel groups; wherein each of the pixel groups comprises an even number of pixels arranged in arrays;

calculating an average gray scale value of blue sub-pixels in each of sub-pixel groups according to an image input signal;

obtaining two groups of target gray scale value pairs according to the average gray scale value; wherein each group of the target gray scale value pairs comprises a high gray scale value and a low gray scale value; a brightness of the high gray scale value and the low gray scale value in the front view is the same as a brightness of the average gray scale value in the front view;

obtaining corresponding two groups of driving voltage pairs according to the two groups of the target gray scale value pairs in each of the pixel groups; and driving the blue sub-pixels on the corresponding pixel group according to the two groups of the driving voltage pairs, wherein in the step of obtaining the two groups of the target gray scale value pairs according to the average gray scale value, the two groups of the target gray scale value pairs are obtained via a gray scale value Look Up Table (LUT); and each of gray scale values in the gray scale value LUT corresponds to the two groups of the target gray scale value pairs, and the step of obtaining the two groups of the target gray scale value pairs according to the average gray scale value comprises:

determining a gray scale range of the average gray scale value of the blue sub-pixels in each of the pixel groups;

obtaining the corresponding gray scale value LUT according to the gray scale range in each of the pixel groups; and obtaining the corresponding two groups of the target gray scale value pairs using the corresponding gray scale value LUT according to the average gray scale value of the blue sub-pixels in each of the pixel groups.

2. The method according to claim 1, wherein each of the pixel groups comprises four pixels arranged in arrays.

3. The method according to claim 1, wherein the method further comprises a step of prestoring the gray scale value LUT.

4. The method according to claim 1, the method further comprises a step of prestoring a correspondence table between various gray scale value ranges and the gray scale value LUTS.

5. The method according to claim 1, wherein the step of obtaining the corresponding two groups of the driving voltage pairs according to the two groups of the target gray scale value pairs in each of the pixel groups is: obtaining the corresponding two groups of the driving voltage pairs using a driving voltage LUT according to the two groups of the target gray scale value pairs in each of the pixel groups.

6. The method according to claim 5, the method further comprises a step of prestoring the driving voltage LUT.

7. The method according to claim 1, wherein in the step of driving the blue sub-pixels on the corresponding pixel group according to the two groups of the driving voltage pairs, the driving voltages of two adjacent blue sub-pixels are different.

8. A display apparatus, comprising:

a display panel, wherein pixels on the display panel are divided into a plurality of pixel groups; wherein each of the pixel groups comprises an even number of pixels arranged in arrays;

a control element comprising one or more processors, and a memory storing computer executable instructions, which, when executed by the one or more processors cause the one or more processors to perform the steps of following units:

a calculating unit configured to receive an image input signal, and calculate an average gray scale value of blue sub-pixels in each of the pixel groups according to the image input signal; and an obtaining unit configured to obtain two groups of target gray scale value pairs according to the average gray scale value; wherein each group of the target gray scale value pair comprises a high gray scale value and a low gray scale value; a brightness of the high gray scale value and the low gray scale value in the front view is the same as a brightness of the average gray scale value in the front view;

wherein the obtaining unit is further configured to obtain corresponding two groups of driving voltage pairs according to the two groups of the target gray scale value pairs in each of the pixel groups; and a driving element connected to the control element and the display panel respectively, wherein the driving element is configured to drive the blue sub-pixels on the corresponding pixel group according to the two groups of the driving voltage pairs, wherein:

the obtaining unit is configured to obtain the corresponding two groups of the target gray scale value pairs using a gray scale value LUT according to the average gray scale value;

each of gray scale values in the gray scale value LUT corresponds to the two groups of the target gray scale value pairs;

the display apparatus further comprises a storing element, and the storing element is configured to store the gray scale value LUT; and when the computer executable instructions are executed by the one or more processors, the one or more processors executes the step in a determining unit and the determining unit is configured to determine a gray scale range of the average gray scale value of the blue sub-pixels in each of the pixel groups;

wherein the obtaining unit is configured to obtain the corresponding gray scale value LUT according to the gray scale range in each of the pixel groups; and obtain the corresponding two groups of the target gray scale value pairs using the corresponding gray scale value LUT according to the average gray scale value of the blue sub-pixels in each of the pixel groups.

9. The display apparatus according to claim 8, wherein each of the pixel groups comprises four pixels arranged in arrays.

10. The display apparatus according to claim 8, wherein the storing element is further configured to store a correspondence table between the respective gray scale ranges and the gray scale value LUTS.

11. The display apparatus according to claim 8, wherein the storing element is further configured to store a driving voltage LUT; the obtaining unit is configured to obtain the corresponding two groups of the driving voltage pairs using the driving voltage LUT according to the two groups of the target gray scale value pairs in each of the pixel groups.

12. The display apparatus according to claim 8, wherein when the driving element drives the blue sub-pixels on the corresponding pixel group according to the two groups of the driving voltage pairs, the driving voltages controlling the two adjacent blue sub-pixels are different.

13. The display apparatus according to claim 8, wherein the display panel is a flat display panel or a curved display panel.

14. A display apparatus, comprising:

a display panel, wherein pixels on the display panel are divided into a plurality of pixel groups; and each of the pixel groups includes four pixels arranged in arrays;

a control element including one or more processors, and a memory storing computer executable instructions, which, when executed by the one or more processors cause the one or more processors to perform the steps of following units:

a calculating unit configured to receive an image input signal and calculate an average gray scale value of blue sub-pixels in each of the pixel groups according to the image input signal; and a determining unit configured to determine a gray scale range of the average gray scale value of the blue sub-pixels in each of the pixel groups; and an obtaining unit configured to obtain a corresponding gray scale value LUT according to the gray scale range in each of the pixel groups, and obtain two groups of the target gray scale value pairs using the corresponding gray scale value LUT according to the average gray scale value of the blue sub-pixels in each of the pixel groups; wherein each group of the target gray scale value pair includes a high gray scale value and a low gray scale value; and a brightness of the high gray scale value and the low gray scale value in the front view is the same as a brightness of the average gray scale value in the front view;

wherein the obtaining unit is further configured to obtain corresponding two groups of the driving voltage pairs according to the two groups of the target gray scale value pairs in each of the pixel groups; and a driving element connected to the control element and the display panel, respectively, wherein the driving element is configured to drive the blue sub-pixels on the corresponding pixel group according to the two groups of the driving voltage pairs.

* * * * *